US006344715B2

(12) United States Patent
Tokunaga et al.

(10) Patent No.: US 6,344,715 B2
(45) Date of Patent: Feb. 5, 2002

(54) PLASMA DISPLAY DEVICE

(75) Inventors: Tsutomu Tokunaga; Nobuhiko Saegusa; Chiharu Koshio; Kimio Amemiya, all of Yamanashi (JP)

(73) Assignees: Pioneer Corporation, Tokyo; Shizuoka Pioneer Corporation, Shizuoka, both of (JP)

( * ) Notice: Subject to any disclaimer, the term of this patent is extended or adjusted under 35 U.S.C. 154(b) by 0 days.

(21) Appl. No.: 09/729,930

(22) Filed: Dec. 6, 2000

(30) Foreign Application Priority Data

Dec. 7, 1999 (JP) ..... 11-347265
Oct. 20, 2000 (JP) ..... 2000-320843

(51) Int. Cl.[7] ..... G09G 3/10

(52) U.S. Cl. ..... 315/169.4; 315/169.3; 345/60; 345/63; 345/68; 313/582

(58) Field of Search ..... 315/169.4, 169.3, 315/169.1; 345/60, 55, 63, 68, 77; 313/581, 582

(56) References Cited

U.S. PATENT DOCUMENTS 5,943,031 A * 8/1999 Tokunaga et al. ..... 345/60
5,982,344 A * 11/1999 Tokunaga ..... 345/67
6,144,163 A * 11/2000 Amemiya et al. ..... 315/169.1
RE37,083 E * 3/2001 Kanazawa ..... 315/169.4
6,243,084 B1 * 6/2001 Nagai ..... 345/210

* cited by examiner

*Primary Examiner*—Don Wong
*Assistant Examiner*—Tuyet T. Vo
(74) *Attorney, Agent, or Firm*—Sughrue Mion, PLLC

(57) ABSTRACT

An object of the present invention is to provide a plasma display device that enables high-luminosity display while keeping consumption of power low. After causing reset discharge to form a wall charge in the dielectric layer of all discharge cells of a plasma display panel, pixel data are written by causing selective erasure discharge to erase, in accordance to pixel data corresponding to an input video signal, the wall charge formed in each discharge cell, and sustaining pulses, with a voltage value of at least 200 volts, are applied alternately to each row electrode of each row electrode pair of the plasma display panel to repeatedly cause sustained discharge to occur only in discharge cells having residual wall charge.

12 Claims, 13 Drawing Sheets

SECTION ALONG V1-V1

SECTION ALONG V2-V2

SECTION ALONG W1-W1

SECTION ALONG W2-W2

SECTION ALONG W3-W3

FIG. 15

| GRADATION | EMISSION DRIVE PATTERN IN 1 FIELD | | | | | | | | | | | | | | EMISSION LUMINANCE |
|---|---|---|---|---|---|---|---|---|---|---|---|---|---|---|---|
| | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1 | ● | | | | | | | | | | | | | | 0 |
| 2 | ○ | ● | | | | | | | | | | | | | 1 |
| 3 | ○ | ○ | ● | | | | | | | | | | | | 4 |
| 4 | ○ | ○ | ○ | ● | | | | | | | | | | | 9 |
| 5 | ○ | ○ | ○ | ○ | ● | | | | | | | | | | 17 |
| 6 | ○ | ○ | ○ | ○ | ○ | ● | | | | | | | | | 27 |
| 7 | ○ | ○ | ○ | ○ | ○ | ○ | ● | | | | | | | | 40 |
| 8 | ○ | ○ | ○ | ○ | ○ | ○ | ○ | ● | | | | | | | 56 |
| 9 | ○ | ○ | ○ | ○ | ○ | ○ | ○ | ○ | ● | | | | | | 75 |
| 10 | ○ | ○ | ○ | ○ | ○ | ○ | ○ | ○ | ○ | ● | | | | | 97 |
| 11 | ○ | ○ | ○ | ○ | ○ | ○ | ○ | ○ | ○ | ○ | ● | | | | 122 |
| 12 | ○ | ○ | ○ | ○ | ○ | ○ | ○ | ○ | ○ | ○ | ○ | ● | | | 150 |
| 13 | ○ | ○ | ○ | ○ | ○ | ○ | ○ | ○ | ○ | ○ | ○ | ○ | ● | | 182 |
| 14 | ○ | ○ | ○ | ○ | ○ | ○ | ○ | ○ | ○ | ○ | ○ | ○ | ○ | ● | 217 |
| 15 | ○ | ○ | ○ | ○ | ○ | ○ | ○ | ○ | ○ | ○ | ○ | ○ | ○ | ○ | 255 |

FILLED CIRCLE: WITH SELECTIVE ERASURE DISCHARGE IN PIXEL DATA WRITING PROCESS Wc

UNFILLED CIRCLE: WITH DISCHARGE EMISSION IN EMISSION SUSTAINING PROCESS Ic

PLASMA DISPLAY DEVICE

BACKGROUND OF THE INVENTION

1. Field of the Invention

The present invention relates to a plasma display device.

2. Description of the Related Art

An AC (alternating current discharge) type plasma display panel is receiving attention as a self-emitting, thin display device.

FIG. 1 shows a general arrangement of a display device that employs such a plasma display panel.

A plasma display panel PDP 10 shown in FIG. 1 has column electrodes $D_1$ to $D_m$, which serve the respective "columns" of the two-dimensional display screen, and row electrodes $X_1$ to $X_n$ and row electrodes $Y_1$ to $Y_n$, which serve the respective "rows," formed respectively on two glass substrates (not shown) that oppose each other. Here, the row electrodes X and Y are aligned alternately on the above-mentioned glass substrate that serves as the two-dimensional display screen. A single row is served by a pair of row electrodes X and Y. Between the respective glass substrates mentioned above a discharge space is provided in which is sealed a mixed noble gas, mainly composed of neon, xenon, etc. At each intersection part of the above-mentioned row electrode pair and column electrode, including the discharge space, there is formed a discharge cell that serves as a pixel.

A driving device 100 applies various drive pulses to the column electrodes $D_1$ to $D_m$ and the row electrodes $X_1$ to $X_n$ and $Y_1$ to $Y_n$ of PDP 10 to cause various types of discharge, corresponding to an input video signal, to occur at each discharge cell of PDP 10. PDP 10 thus provides an image displays corresponding to the video signals by means of the light emitting phenomenon accompanying this discharge.

To display images using a plasma display panel in such a manner, a discharge must be made to occur for each pixel. Presently, a plasma display panel thus tends to be higher in consumption power than a CRT or liquid crystal display. Meanwhile, image displays of higher luminosity are also being desired.

OBJECTS AND SUMMARY OF THE INVENTION

The present invention has been made in view of the above points and an object thereof is to provide a plasma display device with which high luminosity display is enabled while keeping down the power consumption.

A plasma display device of the present invention is equipped with a plasma display panel in which a discharge cell, corresponding to a pixel, is formed at each intersection part of a plurality of row electrodes pairs, corresponding to display lines, and a plurality of column electrodes aligned to intersect the above-mentioned row electrodes. Interposed between the column electrodes and row electrodes is discharge space having sealed therein a dielectric layer, which covers the above-mentioned row electrodes, and a discharge gas. The plasma display device has a general reset means, which causes a reset discharge for forming a wall charge on the above-mentioned dielectric layer of all of the above-mentioned discharge cells. A pixel data writing means causes a selective erasure discharge that selectively erases, in accordance with pixel data corresponding to an input video signal. The above-mentioned wall charge is formed in the above-mentioned discharge cells. An emission sustaining means applies sustaining pulses, having a voltage value of 200 volts or more, alternately to each row electrode of the above-mentioned row electrode pair to cause sustained discharger to occur repeatedly only in the discharge cells in which the above-mentioned wall charge remains.

BRIEF DESCRIPTION OF THE DRAWINGS

FIG. 15 is a diagram that shows emission drive patterns by the drive method illustrated in FIGS. 13 and 14.

DETAILED DESCRIPTION OF THE PREFERRED EMBODIMENTS

An embodiment of the present invention will be described with reference to the drawings.

Figure 1:
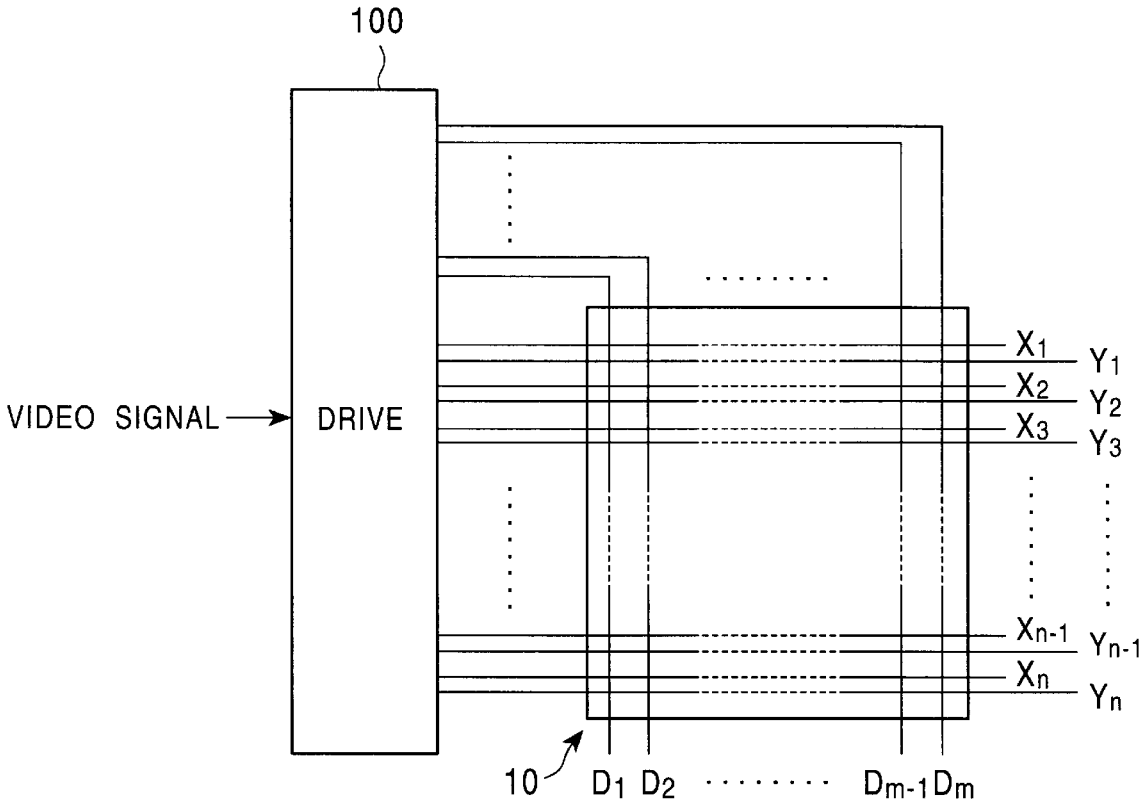
FIG. 1 is a diagram that shows a general arrangement of a plasma display device.
Figure 2:
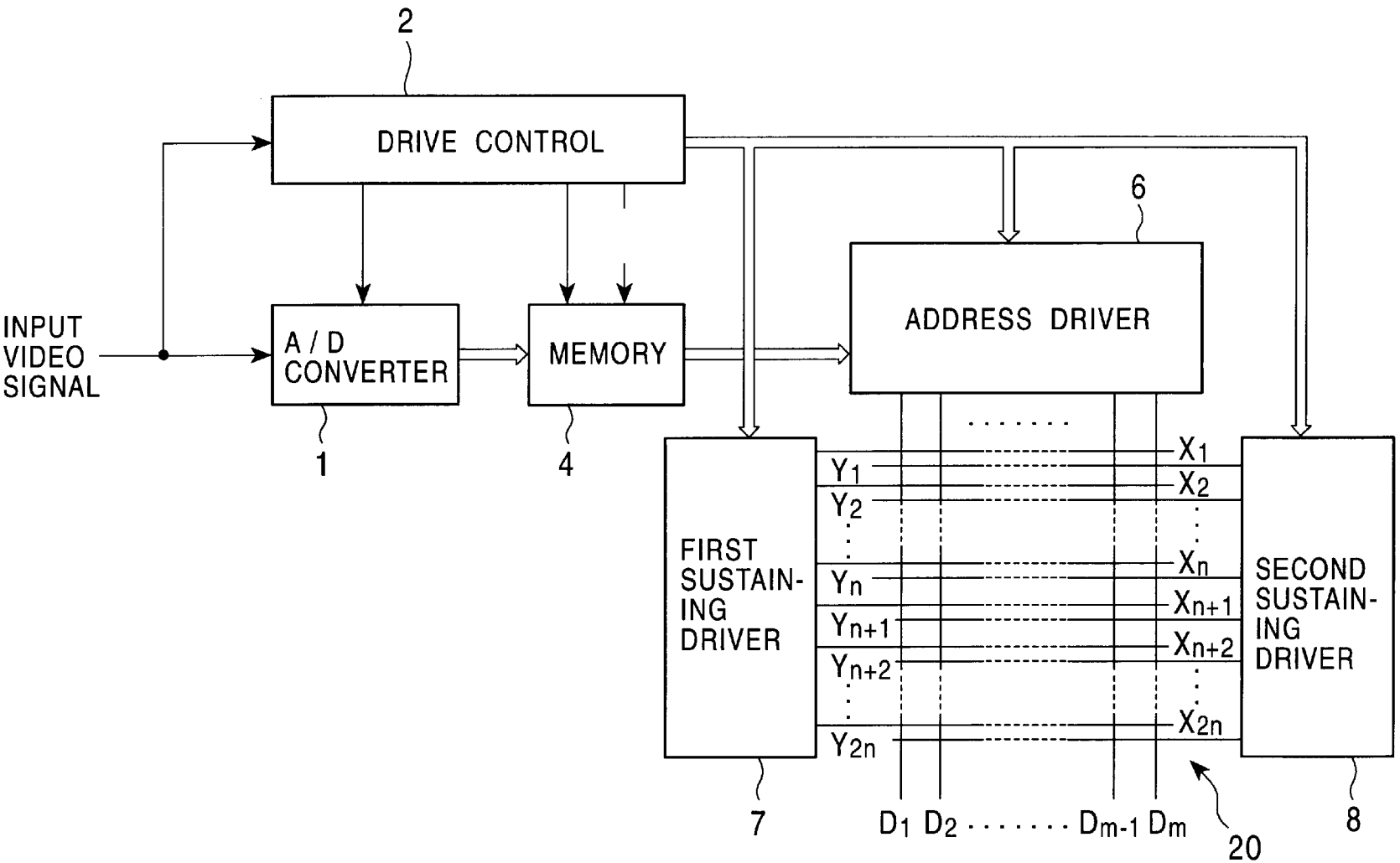
FIG. 2 is a diagram that shows a general arrangement of a plasma display device according to the present invention.

FIG. 2 is a diagram that shows a general arrangement of a plasma display device according to the present invention.

As shown in FIG. 2, this plasma display device is comprised of a driving unit, which in turn is comprised of an A/D converter 1, drive control circuit 2, memory 4, address driver 6, first sustaining driver 7, and a second sustaining driver 8, and a PDP 20, which is the plasma display panel.

Row electrodes $X_1$ to $X_n$ and row electrodes $Y_1$ to $Y_n$ are formed in an alternating and parallel manner inside PDP 20. The structure is such that a pair of mutually adjacent row electrodes X and Y serve each of the first to nth rows of the two-dimensional display screen of PDP 20. Furthermore, column electrodes $D_1$ to $D_m$, which respectively serve the first to mth columns of the two dimensional screen are aligned so as to intersect these row electrodes X and Y.

Figure 3:
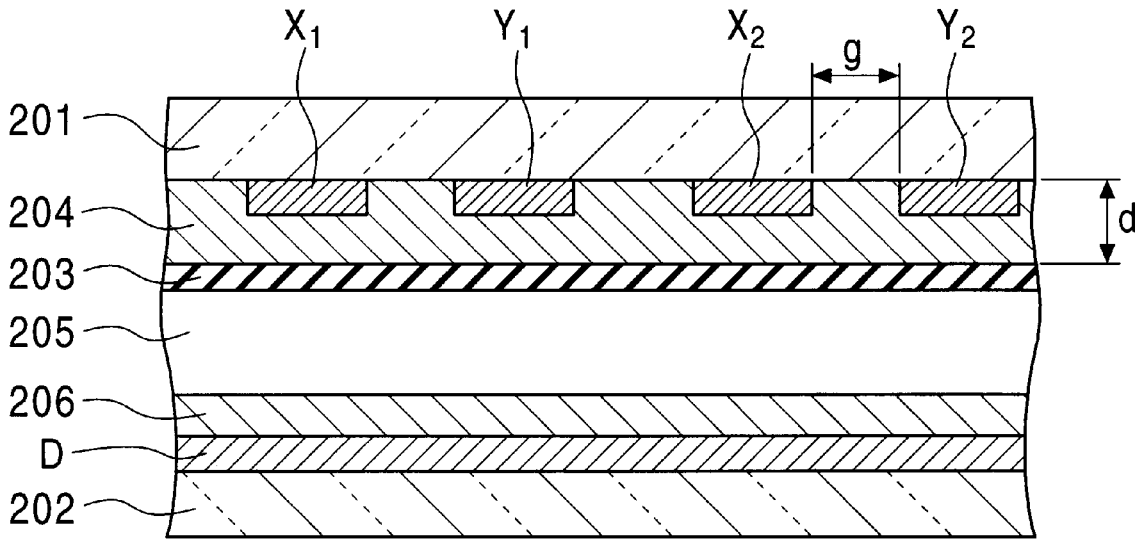
FIG. 3 is a diagram that shows a part of the cross-sectional structure of the plasma display panel shown FIG. 2.

FIG. 3 is a diagram that shows a part of the cross-sectional structure of PDP 20.

As shown in FIG. 3, the above-mentioned row electrodes $X_1$ to $X_n$ and row electrodes $Y_1$ to $Y_n$ are formed in alternating manner on the inner surface of a front glass substrate 201, in other words, the surface that opposes a rear glass substrate 202. These row electrodes X and Y are coated with a dielectric layer 204, on which is vapor deposited a protective layer 203, made of magnesium oxide, etc. The discharge space 205 is formed between this dielectric layer 204 and rear glass substrate 202.

The discharge space 205 is filled with mixed noble gas, as a discharge gas, mainly composed of neon, xenon, and other suitable gas. The proportion of xenon gas mixed in this mixed noble gas is set to 10% (volume) or more of the entire gas.

On the inner surface of rear glass substrate 201, that is, the surface that opposes front glass substrate 202, column electrodes $D_1$ to $D_m$ are formed so as to extend in the direction of intersection with the above-mentioned row electrodes $X_1$ to $X_n$ and row electrodes $Y_1$ to $Y_n$. A fluorescent layer 206 for blue light emission, green light emission, and red light emission is formed so as to cover the wall surfaces of column electrodes $D_1$ to $D_m$. A discharge cell, corresponding to a single pixel, is thus formed at each intersection part of the above-mentioned column electrodes $D_1$ to $D_m$ and row electrodes X and Y, which includes the above-mentioned dielectric layer 204, discharge space 205, and fluorescent layer 206.

A/D converter 1 samples an input analog video signal, which is input in accordance with the clock signal supplied from drive control circuit 2, converts the video signal into pixel data that are in one-to-one correspondence with each pixel, and supplies the pixel data to memory 4. Memory 4 successively writes the above-mentioned pixel data in accordance with the write signal supplied from drive control circuit 2. When the writing of data corresponding to a single screen (n rows×m columns) of PDP 20 by this writing operation is completed, memory 4 reads out the pixel data for this single screen in accordance with a read signal supplied from the above-mentioned drive control circuit 2 and supplies the pixel data to address driver 6.

Figure 4:
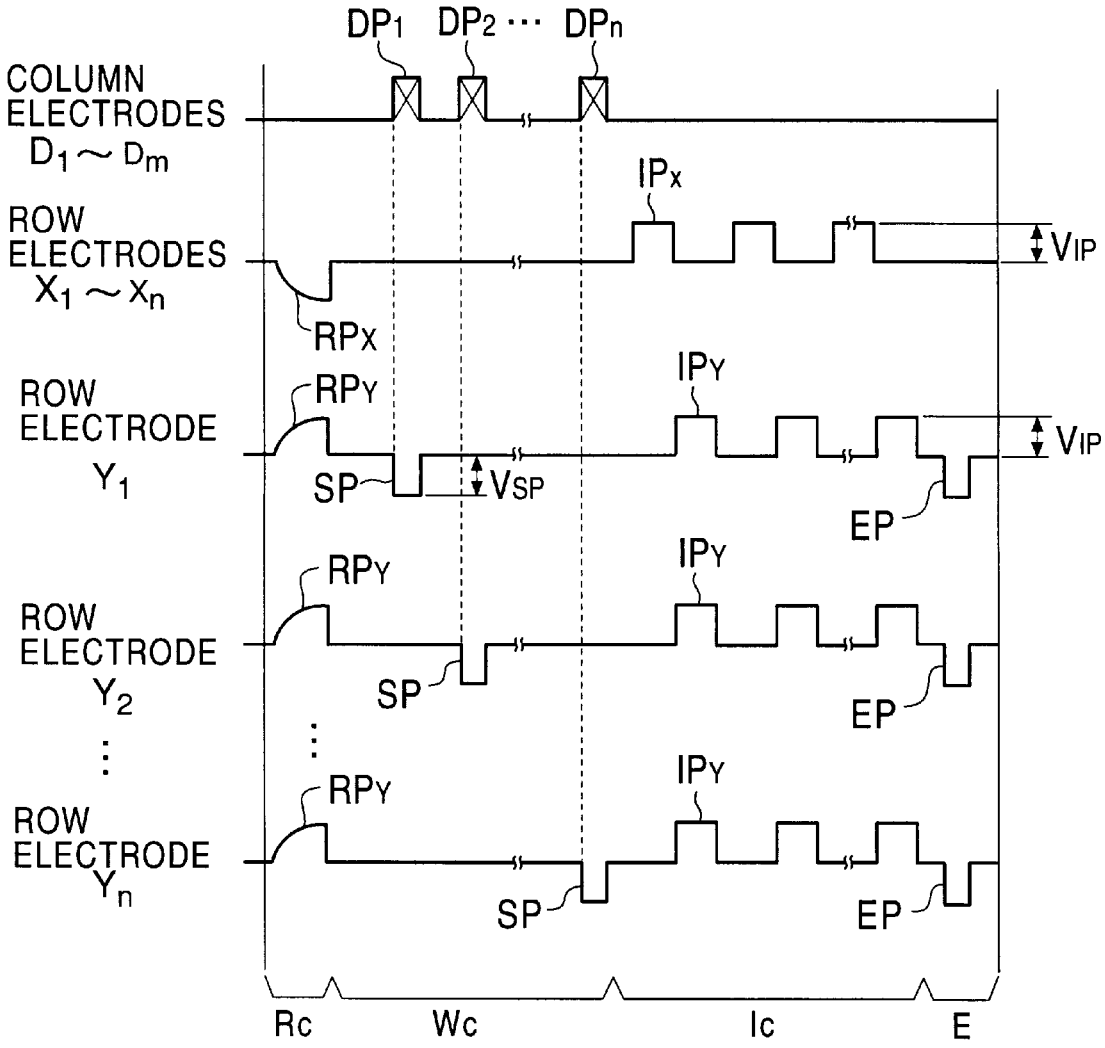
FIG. 4 is a diagram that shows the timings of application of the various drive pulses to be applied to the column electrodes and row electrodes of the plasma display panel shown FIG. 2.

Drive control circuit 2 supplies the various timing signals for applying various drive pulses to PDP 20 to each of address driver 6, first sustaining driver 7, and second sustaining driver 8 according to timings such as shown in FIG. 4.

In FIG. 4, first the first sustaining driver 7 applies a negative-voltage reset pulse $RP_x$ to each of the row electrodes $X_1$ to $X_n$ of PDP 20. At the same time, the second sustaining driver 8 applies a positive-voltage reset pulse $RP_y$ to each of the row electrodes $Y_1$ to $Y_n$ of PDP 20 (general reset process Rc).

By the execution of the above-described general reset process Rc, reset discharge is made to occur in all of the discharge cells in PDP 20, and as a result, a wall charge of predetermined magnitude is formed uniformly in each discharge cell. All of the discharge cells are thereby initialized once to "emitting cells."

Next, address driver 6 generates pixel data pulses of voltages corresponding to the logic levels of the pixel data supplied from the above-mentioned memory 4. For example, if the logic level of an above-mentioned pixel data is "1," address driver 6 generates a high-voltage pixel data pulse. On the other hand, if the logic level is "0," address driver 6 generates a low-voltage (for example, a 0 volt) pixel data pulse. As shown in FIG. 4, address driver 6 successively applies to column electrodes $D_1$to $D_m$, the above-mentioned pixel data pulses corresponding to the respective pixels as sets $DP_1$ to $DP_n$ of pixel data pulses for m columns, with each set corresponding respectively to each of the first to nth rows of PDP 20. Furthermore, in synchronization with the timings of application of each of these pixel data pulse sets DP, second sustaining driver 8 generates and successively applies scan pulses SP of pulse voltage $V_{SP}$ to the row electrodes $Y_1$ to $Y_n$ (pixel data writing process Wc).

By the execution of the above-mentioned pixel data writing process Wc, discharge (selective erasure discharge) occurs only in the discharge cells at the intersection part of the "rows" to which the scan pulses SP were applied and the "columns" to which the high-voltage pixel data pulses were applied. As a result, only the discharge cells in which the selective erasure discharge is made to occur will have eliminated the wall charge that had been formed in the interior thereof. That is, in this case, discharge cells, which had been initialized to the "emitting cell" state in the above-described general reset process Rc, is transited to the "non-emitting cell" state. On the other hand, discharge does not occur and the present state is maintained in discharge cells that are formed in the "columns" to which the low-voltage pixel data pulses were applied. Thus in this case, a discharge cell in the "non-emitting cell" state is maintained as it is as a "non-emitting cell" and a discharge cell in the "emitting cell" state is maintained as it is as an "emitting cell."

Next, each of first sustaining driver 7 and second sustaining driver 8 alternately apply sustaining pulses $IP_x$ and $IP_y$ of predetermined pulse voltage $V_{IP}$ to the row electrodes $X_1$ to $X_n$ and $Y_1$ to $Y_n$ respectively as shown in FIG. 4 (emission sustaining process Ic).

By the execution of this emission sustaining process Ic, sustaining discharge is made to occur each time the above-mentioned sustaining pulse $IP_X$ or $IP_Y$ is applied only in discharge cells, i.e., emission cells, in which the wall charge exists within the discharge cell. When this sustaining discharge occurs, the vacuum ultraviolet light, generated from the xenon gas in the mixed noble gas in discharge space 205 is excited and causes fluorescent layer 206 to emit light.

As has been mentioned above, the proportion of xenon gas in discharge space 205 is 10% or more of the entire gas. Since a plasma display panel emits light by the excitation of the fluorescent body by the vacuum ultraviolet light generated from this xenon gas, when the proportion of xenon gas is increased, the amount of vacuum ultraviolet light increases and the emission efficiency rises accordingly. However, when the proportion of xenon gas is increased in this manner, the voltage values necessary for causing the selective discharge between the column electrodes and the row electrodes and the sustained discharge between row electrodes X and row electrodes Y also become high, i.e., increases. Thus in order to cause discharge of discharge cells with high emission efficiency, the value of the voltage to be applied to each discharge cell to cause this discharge must also be high.

If the proportion of xenon gas is 10% or more to increase the emission efficiency of the plasma display panel as in the present embodiment, the pulse voltage $V_{IP}$ of each of the above-mentioned sustaining pulses $IP_X$ and $IP_Y$ is set to 200 volts or more.

After the completion of the above-mentioned emission sustaining process Ic, second sustaining driver 8 generates and applies a negative-voltage erasure pulse EP to the row electrodes $Y_1$ to $Y_n$ (erasure process E).

By this erasure process E, erasure discharge is made to occur in all discharge cells existing in PDP 20 and the wall charge that remains in each discharge cell disappears. All discharge cells in PDP 20 are thus set to "non-emitting cells" by the erasure discharge.

Address driver 6, first sustaining driver 7, and second sustaining driver 8 repeatedly execute the series of operations comprised of the above-mentioned general reset process Rc, pixel data writing process Wc, emission sustaining process Ic, and erasure process E. As a result, halftone display luminosities are obtained in correspondence to the number of times of emission accompanying the sustained discharge caused in the above-mentioned emission sustaining process Ic.

With the above-described embodiment, a high-luminosity display is enabled by increasing the emission efficiency of the respective discharge cells by making the proportion of the xenon gas in the discharge gas, sealed in discharge space 205 of PDP 20, 10% (volume) or more of the entire gas. When the proportion of xenon gas is 10% (volume) or more of the entire gas as in the present case, the value of the pulse voltage of the sustaining pulse must be 200V or more. However, in this invention, a so-called selective erasure addressing method, in which a wall charge is formed in advance in all discharge cells (general reset process Rc) and this wall charge is selectively eliminated in accordance with the pixel data (pixel data writing process Wc), is employed as the method of writing pixel data in PDP 20. Since a wall charge obviously remains in a discharge cell immediately prior to the selective erasure discharge that is to be caused to eliminate the wall charge in the pixel data writing process Wc, the pulse voltage $V_{SP}$ of the above-mentioned scan pulse SP to be applied to PDP 20 to cause the above-mentioned selective erasure discharge can be of lower voltage than the pulse voltage $V_{IP}$ of the sustaining pulse IP. Since the pulse voltage value of the scan pulse can thus be set low for driving a plasma display panel of high emission efficiency, with which the voltage value of the sustaining pulse is 200V or more, it becomes possible to use a general-purpose scan driver Ic.

However, if the mixing proportion of xenon gas in discharge space 205 is set to at least 10% (by volume) or more, though the emission efficiency of the discharge cell will increase, the discharge starting voltage will increase accordingly. If the discharge starting voltage increases, a time lag will arise between the point at which the above-mentioned scan pulse SP is applied to PDP 20 and the point at which the selective erasure discharge actually occurs. Thus in this case, each of scan pulses SP must be made longer in pulse width as shown in FIG. 4 in order to make selective erasure discharge occur correctly. Thus, there arose the problem that the time consumed by the pixel data writing process Wc increased.

Thus in place of the PDP 20 of the structure shown in FIG. 3, the PDP 20' of the structure shown in FIGS. 5 to 10 is employed as the PDP to be installed in the plasma display device shown in FIG. 2.

Figure 5:
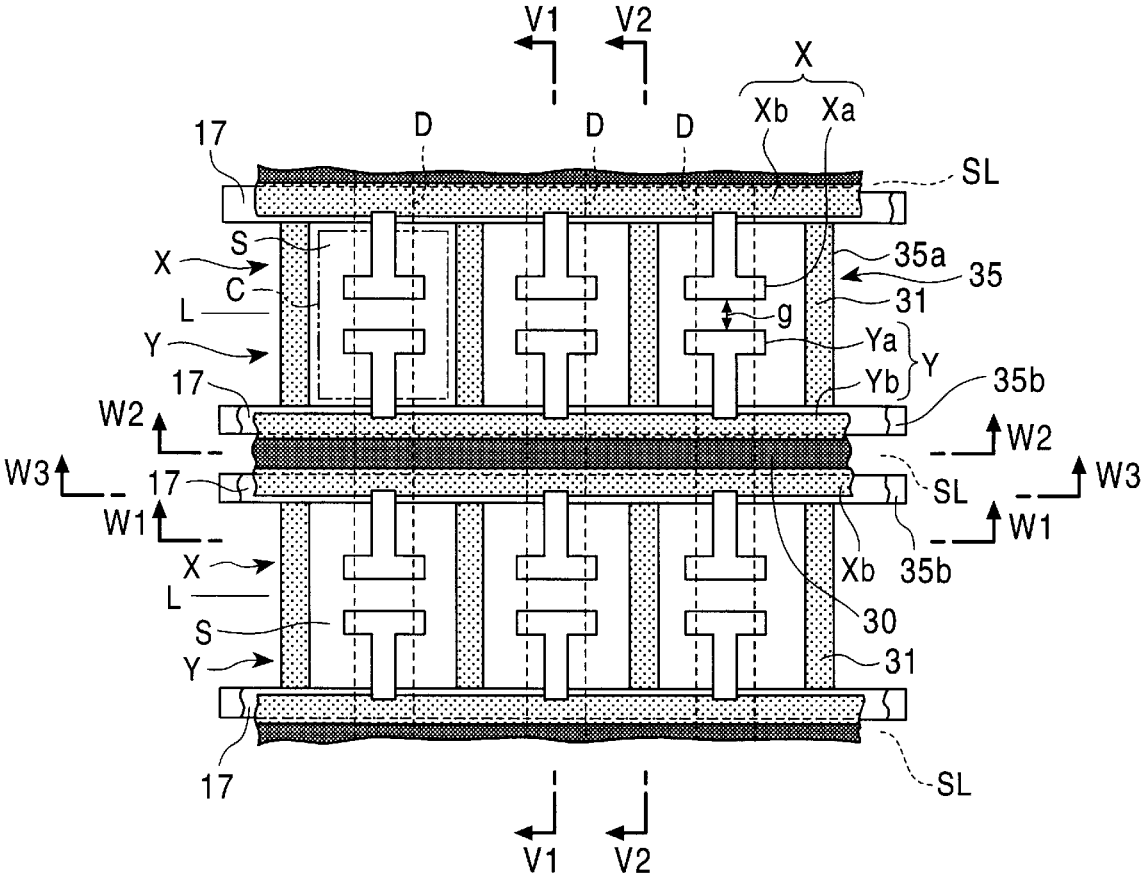
FIG. 5 is a plan view, which schematically shows another plasma display panel.

FIG. 5 is a plan view that schematically illustrates this PDP 20'.

Figure 6:
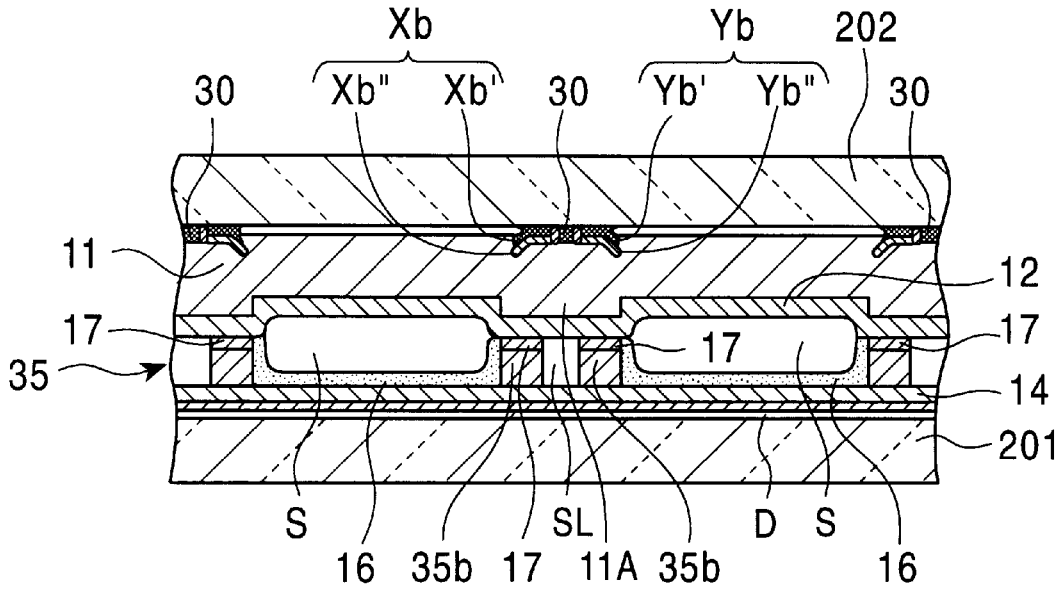
FIG. 6 is a sectional view of the plasma display panel along line a V1—V1 of FIG. 5.
Figure 7:
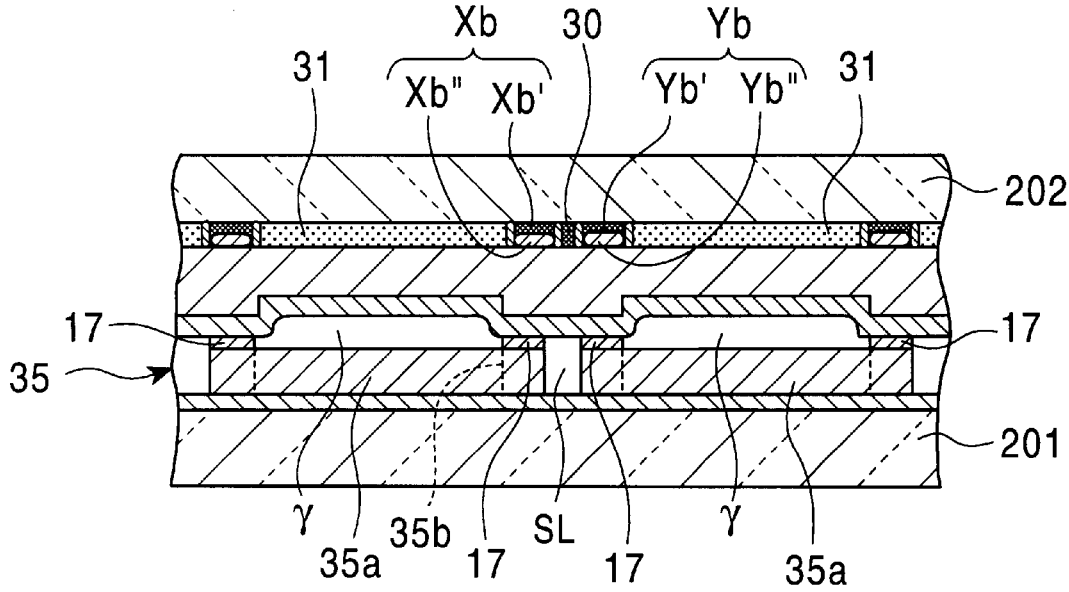
FIG. 7 is a sectional view of the plasma display panel along line a V2—V2 of FIG. 5.
Figure 8:
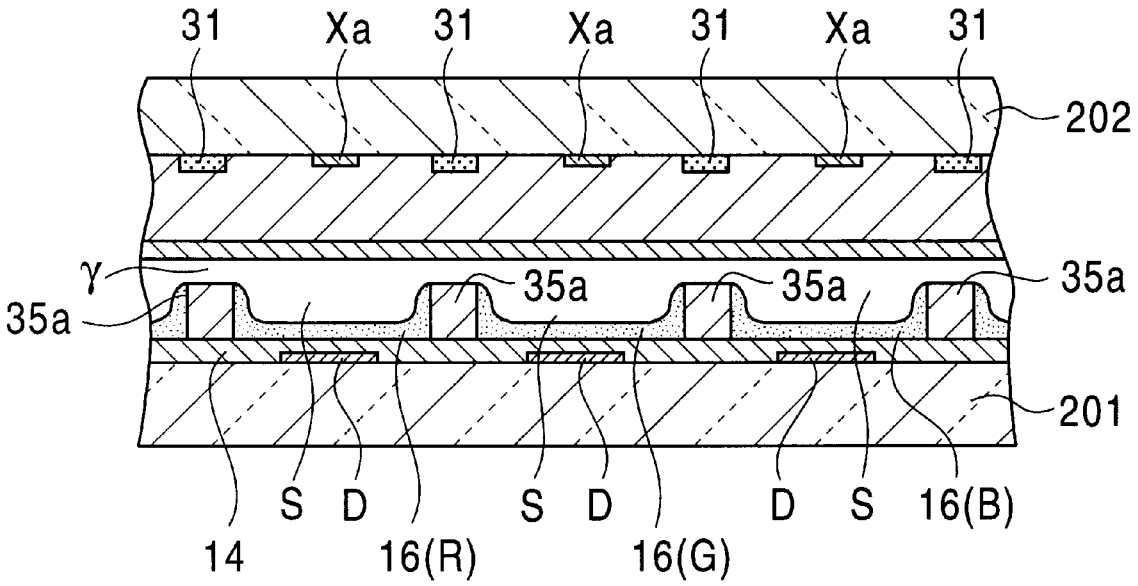
FIG. 8 is a sectional view of the plasma display panel along line a W1—W1 of FIG. 5.
Figure 9:
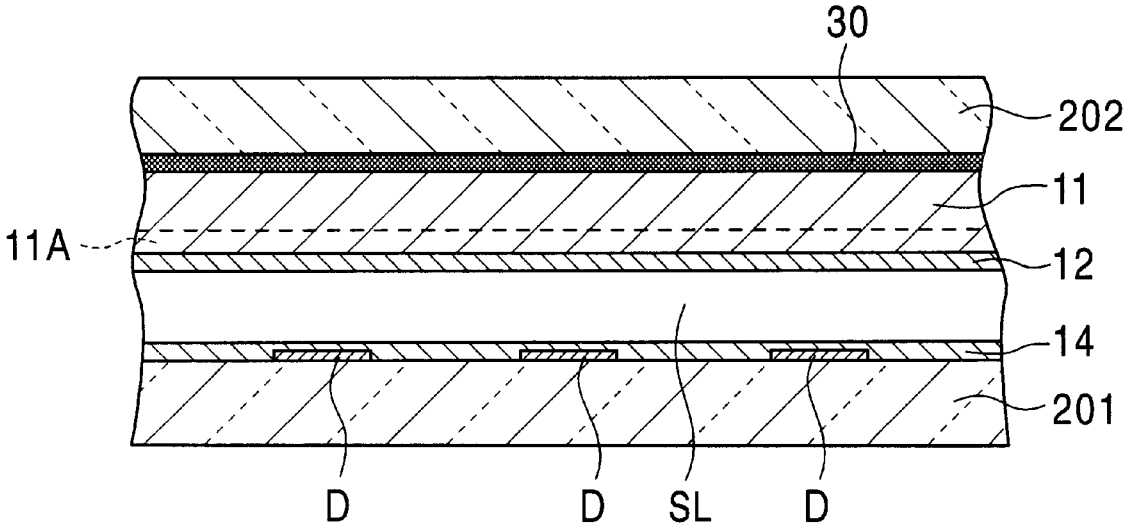
FIG. 9 is a sectional view of the plasma display panel along line a W2—W2 of FIG. 5.
Figure 10:
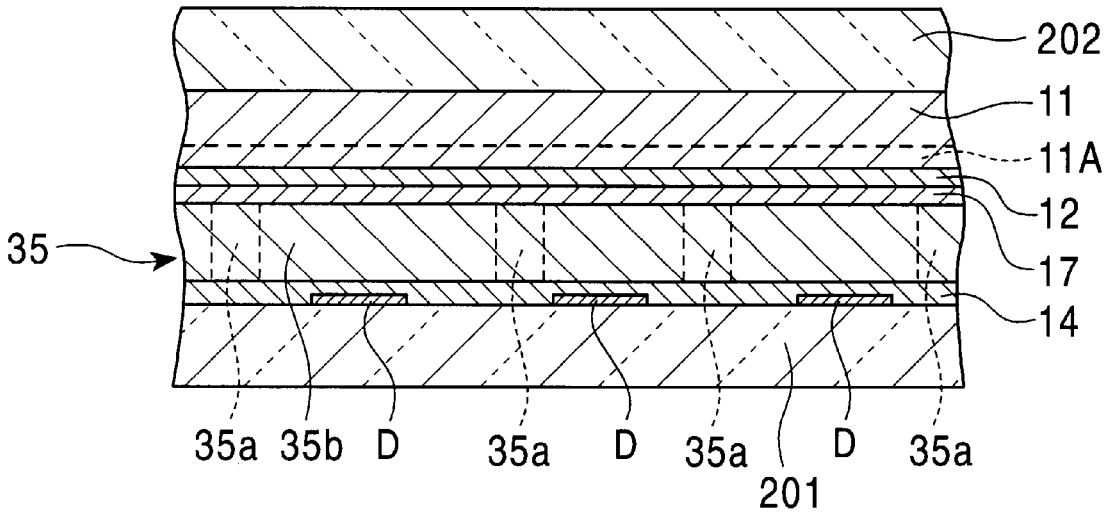
FIG. 10 is a sectional view of the plasma display panel along line a W3—W3 of FIG. 5.

FIG. 6 is a sectional view along line V1—V1 of FIG. 5, FIG. 7 is a sectional view along line V2—V2 of FIG. 5, FIG. 8 is a sectional view along line W1—W1 of FIG. 5, FIG. 9 is a sectional view along line W2—W2 of FIG. 5, and FIG. 10 is a sectional view along line W3—W3 of FIG. 5.

As shown in FIGS. 5 to 10, PDP 20' has on the rear surface of front glass substrate 202, which is the display surface, a plurality of row electrode pairs (X, Y) aligned in parallel so as to extend along the row direction (left-right direction of FIG. 5) of the above-mentioned front glass substrate 202.

Row electrode X is arranged from a transparent electrode Xa, which is comprised of a transparent conductive film of ITO (indium—tin oxide), etc. that has been formed to have the shape of a T, and a bus electrode Xb, which is comprised of a metal film that extends in the row direction of front glass substrate 202 and is connected to the narrow base end part of transparent electrode Xa. Likewise, row electrode Y is arranged from a transparent electrode Ya, which is comprised of a transparent conductive film of ITO, etc. that has been formed to have the shape of a T, and a bus electrode Yb, which is comprised of a metal film that extends in the row direction of front glass substrate 202 and is connected to the narrow base end part of transparent electrode Ya. Row electrodes X and Y are aligned in an alternating manner in the column direction (up-down direction of FIG. 5) of front glass substrate 202. The transparent electrodes Xa and Ya, which are aligned in parallel along bus electrodes Xb and Yb, are respectively formed so as to extend mutually towards the row electrode with which a pair is formed. The wide top parts of the transparent electrodes Xa and Ya are respectively disposed so as to oppose each other across a discharge gap g of prescribed width. Bus electrodes Xb and Yb are respectively formed to have a two-layer structure comprised of a black conductive layer Xb' or Yb' at the display surface side and a main conductive layer Xb" or Yb" at the rear surface side. Black light absorbing layers (light shielding layers) 30 and 31 are respectively formed on the rear surface of front glass substrate 202. Light absorbing layer 30 is formed between bus electrodes Xb and Yb and so as to extend in the row direction along these bus electrodes Xb and Yb. Light absorbing layer 31 is formed at portions that oppose the vertical walls 35*a* of partition walls 35. On the rear surface of front glass substrate 202, a dielectric layer 11 is formed so as to cover the row electrode pairs (X, Y). On the rear surface of this dielectric layer 11, a padding dielectric layer 11A is formed so as to extend in parallel to bus electrodes Xb and Yb. Padding dielectric layer 11A is formed to protrude to the rear surface side of dielectric layer 11 at positions opposing the adjacent bus electrodes Xb and Yb of mutually adjacent row electrode pairs (X, Y) and positions that oppose the region between adjacent bus electrodes Xb and Yb. A protective layer (protective dielectric layer) 12, made of MgO, is formed on the rear surface side of the above-described dielectric layer 11 and padding dielectric layer 11A.

On the display side surface of rear glass substrate 201, which is disposed in parallel to front glass substrate 202, column electrodes D are aligned in parallel, spaced apart mutually by prescribed intervals, and so as to extend in a direction perpendicular to the row electrode pairs (X, Y). A white dielectric layer 14, which covers column electrodes D, is furthermore formed on the display side surface of rear glass substrate 201. Partition walls 35 are formed on dielectric layer 14. Each partition wall 35 is formed to have a ladder-like form by the vertical walls 35*a*, which extend in the column direction between the respective column electrodes D, and transverse walls 35*b*, which extend in the row direction at positions opposing padding dielectric layer 11A. By the ladder-like partition walls 35, the space between front glass substrate 202 and rear glass substrate 201 is partitioned into parts that oppose the transparent electrodes Xa and Ya, and a discharge space S is formed in each partition. As shown in FIGS. 4 and 7, the display side surfaces of vertical walls 35*a* of partition wall 35*a* are not in contact with protective layer 12 and there is a gap r in between. As shown in FIGS. 3 and 6, the display side surfaces of transverse walls 35*b* are also not in direct contact with the portions of protective layer 12 that cover the padding dielectric layer 11A. On the side surfaces of vertical walls 35*a* and transverse walls 35*b* of each partition wall 35 that face the discharge space S and on the surface of dielectric layer 14, a fluorescent layer 16 is formed so as to cover all of these five surfaces. As shown in FIG. 8, fluorescent layer 16 is actually comprised of a red fluorescent layer 16(R), a green fluorescent layer 16(G), and a blue fluorescent layer 16(B), and these are formed in each discharge space S so as to be aligned successively in the column direction.

The discharge space S is filled with a mixed noble gas, as a discharge gas, mainly comprised of neon, xenon, and other suitable gas. The proportion of xenon gas mixed in this mixed noble gas is set to 10% (volume) or more of the entire gas. The transverse wall 35*b* of each ladder-like partition wall that partitions discharge space S is separated from the transverse wall 35*b* of an adjacent partition wall 35 by a gap SL, which exists at a position that overlaps with the light absorbing layer 30 between the display lines. That is, the partition walls 35, which are formed in ladder-like form, extend along the display line (row) L direction and are aligned in the column direction so as to be parallel to each other across the gaps SL that extend along the display lines L. The width of each transverse wall 35*b* is set so as to be substantially equal to the width of each vertical wall 35*a*. As has been mentioned above, each discharge space S, partitioned by the ladder-like partition wall 35, serves as one discharge cell C.

As shown in FIGS. 6, 7, and 10, PDP 20' furthermore has an ultraviolet light emission layer 17 formed at portions on the rear surface side of protective layer 12 that oppose the display side surfaces of the transverse walls 35*b* of the respective partition walls 35. The interval between each discharge space S and gap SL is shielded by the contact of ultraviolet light emission layer 17 with the display side surfaces of transverse walls 35*b*. The ultraviolet light emission layer may also be formed on the display side surface of transverse walls 35*b* of partition wall 35.

The above-mentioned ultraviolet light emission layer 17 is excited by vacuum ultraviolet rays of 147 nm wavelength that are emitted by the xenon gas in discharge space S, during discharge. The ultraviolet light emission layer 17 exhibits phosphorescence, which cause the ultraviolet light emission layer 17 to emit ultraviolet rays. The ultraviolet light emission layer 17 can emit the rays for more than 0.1 msec, preferably, more than 1 msec which is required for the above pixel data writing process Wc. Ultraviolet light emitting fluorescent substances with such phosphorescence include, for example, BAM materials, such as $BaSi_2O_s:Pb^{2+}$ (emission wavelength: 350 nm), $SrB_4O_7F:Eu^{2+}$ (emission wavelength: 360 nm), $(Ba, Mg, Zn)_3Si_2O_7:Pb^{2+}$ (emission wavelength: 295 nm), and $Ba_XMg_Y(Al_2O_7)_Z$ (emission wavelength: 258 nm), as well as $YF_3$:Gd, Pr, etc. Ultraviolet light emission layer 17 may also to contain a material of low work function (that is, a material with a high secondary electron emission coefficient), for example, a material with a work function of 4.5 eV or less. Examples of materials having a low work function and yet having insulation property include MgO (work function: 4.2 eV), $TiO_2$, oxides of alkali metals (for example, $Cs_2O$; work function: 2.3 eV), oxides of alkaline earth metals (for example, CaO, SrO, BaO), fluorides (for example $CaF_2$, $MgF_2$), and materials with which the secondary electron emission coefficient has been increased by introduction of an impurity level within the crystal by means of a crystal defect or impurity, etc. (for example, MgOx, with which the composition ratio of MgO has been changed from 1:1 to introduce a crystal defect). In this case, since secondary electrons (priming particles) are emitted from the low work function material contained in ultraviolet light emission layer 17, the priming effect is improved further.

The driving of the above-described PDP 20' is performed by the sub-field method in the same manner as was described with FIG. 4.

That is, in each sub-field, the general reset process Rc, pixel data writing process Wc, and emission sustaining process Ic are performed successively as shown in FIG. 4. First in the general reset process Rc, reset discharge is made to occur in all discharge cells C to form a wall charge in all discharge cells. Next in the pixel data writing process Wc, scan pulses SP are successively applied according to the respective display lines to subject the discharge cells C selectively to erasure discharge (selective erasure discharge). Each discharge cell C is thereby set to the "emitting cell" state (state in which a wall charge is formed on the dielectric layer 11) or the "non-emitting cell" state (state in which a wall charge is not formed on the dielectric layer 11). Then in the emission sustaining process Ic, sustaining pulses IP of a number corresponding to the weighing of each sub-field are applied alternately to all row electrode pairs (X, Y). In a discharge cell in the above-mentioned "emitting cell" state, discharge occurs each time a sustaining pulse IP is applied. The respective fluorescent layers 16 are thereby excited and made to emit light respectively by the ultraviolet rays that accompany the above-mentioned discharge and this emitted light is transmitted through front glass substrate 202 to produce the displayed image.

In the process of the reset discharge in the above-described general reset process Rc, vacuum ultraviolet rays of 147 nm wavelength are emitted from the xenon gas in discharge space S and the above-described ultraviolet light emission layer 17 is excited by this vacuum ultraviolet rays and thereby made to emit ultraviolet rays. The ultraviolet rays emitted from ultraviolet light emission layer 17 cause secondary electrons to be emitted from protective layer 12 and cause priming particles to be formed in discharge space S continuously over the period in which pixel data writing process Wc is performed. Since priming particles remain in discharge space S, the above-described selective erasure discharge is made to occur immediately in response to the application of a scan pulse SP during the pixel data writing process Wc.

Thus even if the discharge starting voltage has been made high due to setting the mixing proportion of xenon gas in discharge space 205 to 10% (volume) or more, selective erasure discharge can be made to occur correctly without widening the pulse width of scan pulse SP. Furthermore, with the ultraviolet light emission layer 17, the voltage margin with respect to the pulse voltage value of scan pulse SP can be made relatively large even when the pulse width of scan pulse SP is narrowed.

Figure 11:
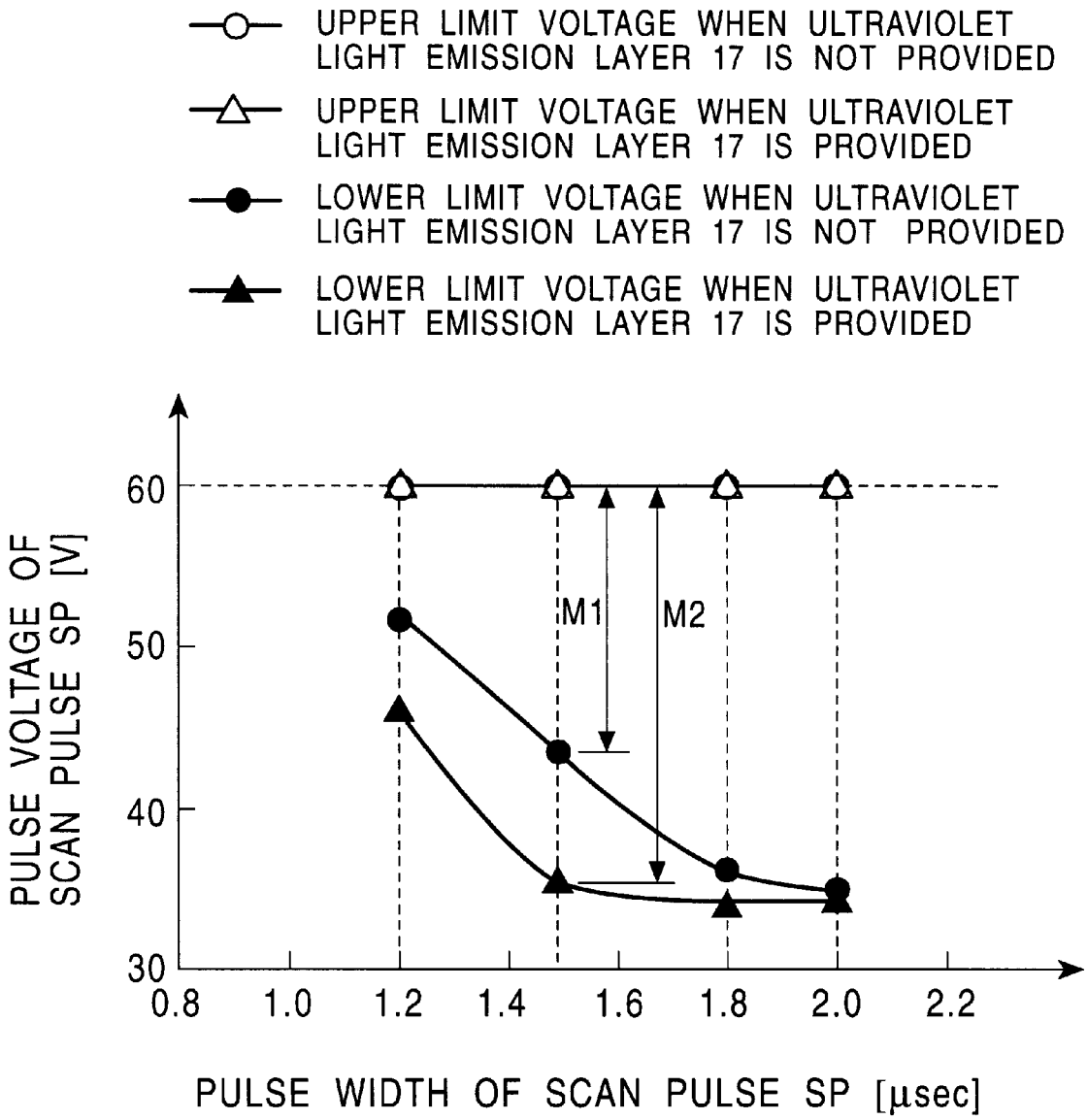
FIG. 11 is a diagram that shows correspondence between the upper and lower limit values of the pulse voltage value of scan pulse SP and the pulse width of scan pulse SP.

FIG. 11 is a diagram that illustrates the correspondence between the upper and lower limit values of the pulse voltage value of scan pulse SP and the pulse width of scan pulse SP.

The upper limit value is the value that indicates the upper limit of the pulse voltage value of scan pulse SP by which selective erasure discharge can be made to occur correctly even in the case where no priming particles exist whatsoever in discharge space S. Meanwhile, the lower limit value of the pulse voltage value of scan pulse SP is the value that indicates the lower limit of the pulse voltage value of scan pulse SP by which selective erasure discharge can be made to occur correctly when priming particles exist in discharge space S. That is, in order to make selective erasure discharge occur correctly, the pulse voltage value of scan pulse SP must be within the range defined by the above-described upper limit and lower limit values. The wider the range defined by the upper limit and lower limit values, the greater will be the voltage margin of the pulse voltage value that scan pulse SP can take on.

In FIG. 11, the upper limit value of the pulse voltage that scan pulse SP can take on is, as indicated by the unfilled circles or unfilled triangles, approximately 60 volts, regardless of the pulse width of scan pulse SP. Meanwhile, the lower limit value, as indicated by the filled circles or filled triangles, increases as the pulse width of scan pulse SP becomes smaller. However, as shown in FIG. 11, the lower limit value (indicated by the filled triangle) for the case where ultraviolet light emission layer 17 is provided is lower than the lower limit value (indicated by the filled circle) for the case where ultraviolet light emission layer 17 is not provided. Thus the range defined by the upper limit and lower limit values that the pulse voltage value of scan pulse SP can take, that is, the voltage margin is increased greater by the provision of ultraviolet light emission layer 17. For example as shown in FIG. 11, in the case where the pulse width of scan pulse SP is 1.5 $\mu$sec, the voltage margin M2 for the case where ultraviolet light emission layer 17 is provided will be greater than the voltage margin M1 for the case where ultraviolet light emission layer 17 is not provided.

Also with PDP 20', the transverse walls 35*b* of partition walls 35 that are mutually adjacent in the column direction are separated from each other by a gap SL that extends in the row direction and the widths of these transverse walls 35*b* are made substantially equal to the widths of vertical walls 35*a*. The warping of front glass substrate 202 and rear glass substrate 201 in the process of baking partition walls 35 and deformation of the discharge cell shapes due to breakage, etc. of partition walls 35 can thus be prevented.

Furthermore, with the above-described PDP 20', the portions of the rear surface of front glass substrate 202 besides the portions that oppose discharge space S are covered by light absorbing layers 30 and 31 and black dielectric layers Xb' and Yb'. The reflection of external light that enters upon transmission through front glass substrate 202 is thereby prevented to improve the contrast of the display screen. Though light absorbing layers 30 and 31 are provided in the above-described embodiment, just one of either may be formed instead.

Also, color filter layers (not shown), which respectively correspond to the red fluorescent layer 16(R), green fluorescent layer 16(G), and blue fluorescent layer 16(B), may be formed on the rear surface of front glass substrate 202 in accordance with the respective discharge cells C. Light absorbing layers 30 and 31 are formed at gaps or positions corresponding to gaps of the color filter layers formed in an island-like manner so as to oppose the respective discharge spaces S.

Figure 12:
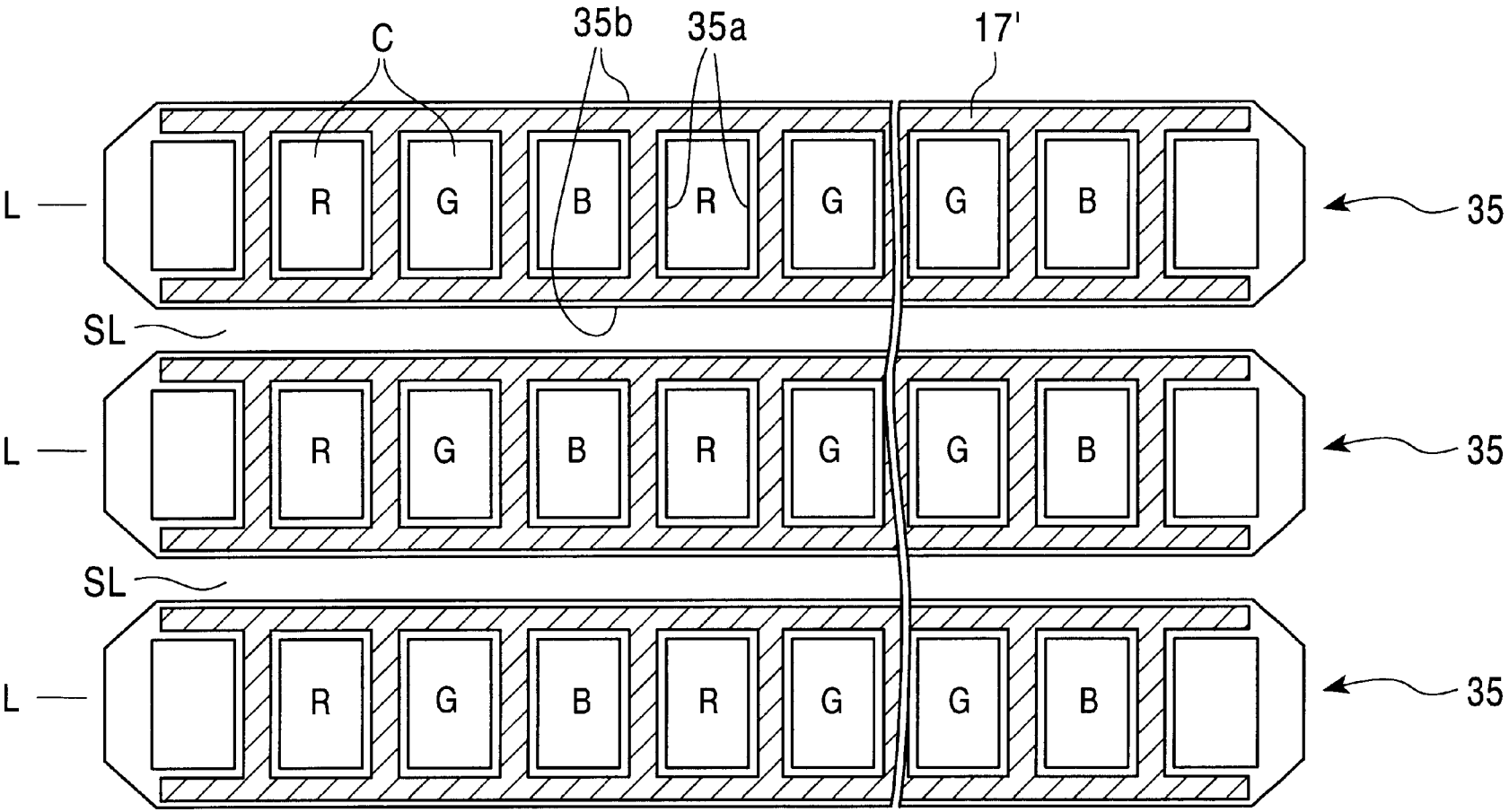
FIG. 12 is a diagram that shows another arrangement of the plasma display panel shown FIG. 5.

Also, though with the above-described PDP 20', ultraviolet light emission layer 17 was disposed only between the rear side surface of protective layer 12 and the display side surfaces of transverse walls 35*b* of partition walls 35, an ultraviolet light emission layer 17' may be formed on the display side surfaces of vertical walls 35*a* of partition walls 35 as shown in FIG. 12. Also, ultraviolet light emission layer 17' may be disposed at positions, at the rear surface side of protective layer 12 that oppose the vertical walls 35*a*, that face the interior of the discharge spaces of the respective discharge cells between vertical walls 35*a* and protective layer 12. By this arrangement, the area of ultraviolet light emission layer 17' in contact with the discharge spaces of discharge cells C is increased and the amount of priming particles generated can be increased accordingly.

Figure 13:
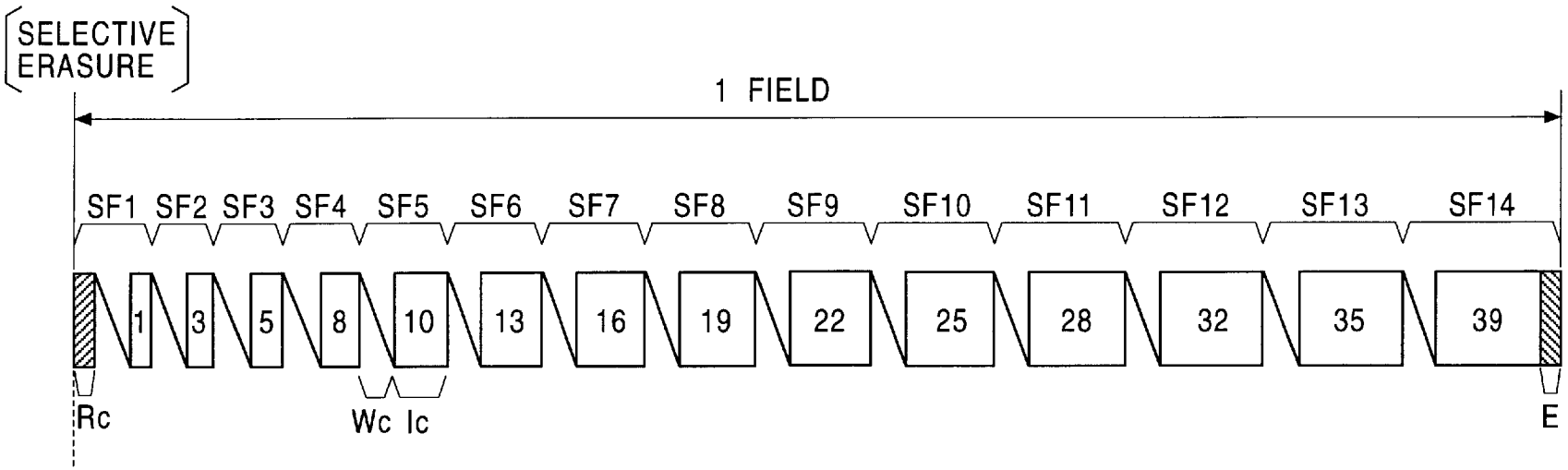
FIG. 13 is a diagram that shows an example of an emission drive format employed for driving the plasma display panel shown FIG. 5.
Figure 14:
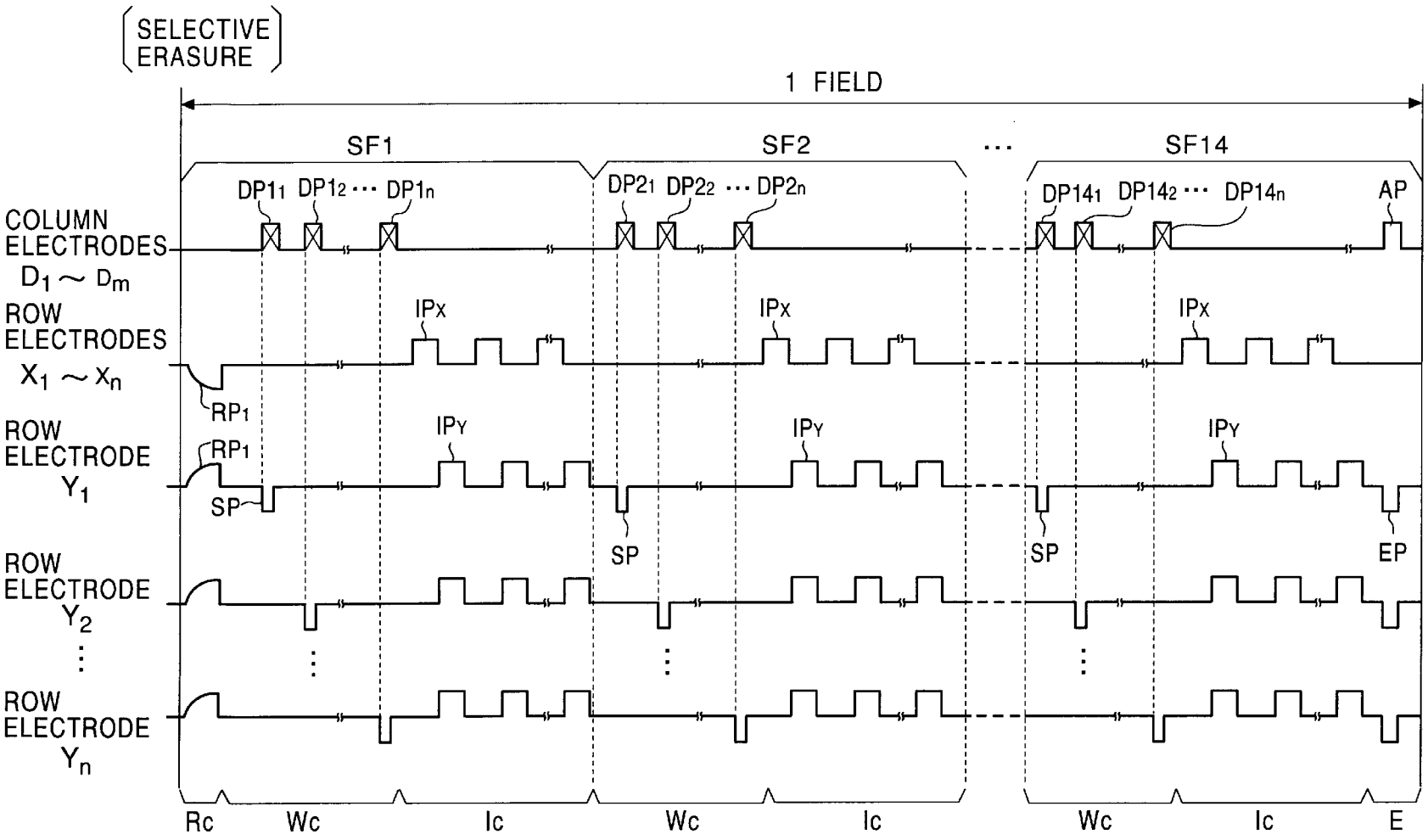
FIG. 14 is a diagram that shows various drive pulses that are applied to the plasma display panel shown FIG. 5 based on the emission drive format shown in FIG. 13.

Also, the above-described priming effect may be increased further by driving PDP 20' according to the driving method illustrated in FIGS. 13 to 15.

FIG. 13 is a diagram that shows the format for the emission drive in a single field display period in the process of driving PDP 20'. FIG. 14 is a diagram that shows the timings of application of the various drive pulses to be applied to column electrodes $D_1$ to $D_m$ and row electrodes $X_1$ to $X_n$ and $Y_1$ to $Y_n$ of PDP 20' in accordance with the above-mentioned emission drive format.

With the drive method illustrated in FIGS. 13 and 14, the display period of one field is divided into the 14 sub-fields of SF1 to SF14 to perform the driving of PDP 20'. As with the drive illustrated in FIG. 4, in each sub-field, the pixel data writing process Wc is executed in which discharge cells are selectively subject to erasure discharge in accordance with the pixel data to erase the wall charge remaining in the discharge cells, thereby making these discharge cells undergo the transition to the non-emitting cell state. Furthermore in each sub-field, the emission sustaining process Ic is executed in which only the discharge cells that are in the emitting cell state are made to undergo sustained discharge repeatedly. As is indicated in FIG. 13, the numbers of times (the periods) of the emission that accompanies the sustained discharge, which is made to occur in each emission sustaining process Ic of each of the sub-fields SF1 to SF14, are set as follows:

SF1: 1
SF2: 3
SF3: 5
SF4: 8
SF5: 10
SF6: 13
SF7: 16
SF8: 19
SF9: 22
SF10: 25
SF11: 28
SF12: 32
SF13: 35
SF14: 39

Furthermore in the drive method illustrated in FIGS. 13 and 14, the general reset process Rc, in which a wall charge is formed in all discharge cells to initialize all discharge cells to the emitting cell state, is executed only in the first sub-field SF1. Also as indicated by the filled circles in FIG. 15, with the drive method illustrate in FIGS. 13 and 14, the selective erasure discharge, by which discharge cells are made to undergo the transition to the non-emitting cell state, is made to occur only in the pixel data writing process Wc of one sub-field among the sub-fields SF1 to SF14. A discharge cell that has been set once to the non-emitting cell state will not undergo the transition to the emitting cell state in subsequent sub-fields. That is, as indicated by the unfilled circles in FIG. 15, with the drive method illustrated in FIGS. 13 and 14, discharge emission is always made to occur successively in the emission sustaining process Ic in each of the n (n=0 to N) sub-fields that follow consecutively after the first sub-field SF1. Thus when driving is performed in the 14 sub-fields SF1 to SF14, the number of emission drive patterns within one field display period will be 15 as shown in FIG. 15. The emission luminance ratios based on these emission drive patterns will be

{0, 1, 4, 9, 17, 27, 40, 56, 75, 97, 122, 151, 182, 217, 256} and halftoning at 15 gradations will thus be performed.

That is, with the drive illustrated in FIGS. 13 and 14, a display of (N+1) gradations is realized by N sub-fields.

As shown in FIG. 15, with this drive method, sustained discharge in the emission sustaining process Ic or reset discharge in the general reset process Rc is always executed immediately prior to the execution of selective erasure discharge. Thus when a drive method such as illustrated in FIGS. 13 to 15 is employed, the priming effect by ultraviolet light emission layer 17 can be used more effectively.

Though the emission efficiency of the discharge cells was increased in the present embodiment by setting the proportion of the xenon gas in discharge space 205 to 10% (volume) or more, such a result may be obtained by another method.

For example, the emission efficiency may be increased by widening the surface discharge gap g between the row electrodes X and Y that form pairs as shown in FIG. 3 or by making the film thickness d of dielectric layer 204 thick. A pulse voltage value of 200V or more will be necessary for the sustaining pulse to be applied to the discharge cells in the case where the above-mentioned surface discharge gap g is set to 100 $\mu$m or more or in the case where the film thickness d of dielectric layer 204 is set to 30 $\mu$m or more.

With the plasma display device of this invention, high-luminosity image displays are enabled by increasing the emission efficiency while restraining the consumption of power by making the voltage value of the sustaining pulse lower than the voltage value of the scanning pulse.

What is claimed is:

1. A plasma display device provided with a plasma display panel comprising, a plurality of row electrode pairs corresponding to display lines, a dielectric layer for covering with said plurality of row electrodes pairs, and a plurality of column electrodes intersecting said plurality of row electrode pairs through discharge space to define a discharge cell corresponding to a pixel at intersection, said discharge space being filled with a discharge gas, said plasma display device having general reset means, which causes a reset discharge for forming a wall charge on said dielectric layer of all of said discharge cells, pixel data writing means, which causes a selective erasure discharge that selectively erases, in accordance with pixel data corresponding to an input video signal, said wall charge formed in said discharge cells, and emission sustaining means, which applies sustaining pulses, having a voltage value of at least 200 volts, alternately to each row electrode of said pair of row electrodes to cause only the discharge cells, in which said wall charge remains, to undergo sustained discharge repeatedly.

2. A plasma display device as set forth in claim 1, wherein said discharge gas is a mixed noble gas in which xenon gas comprises at least 10% of all the discharge gas.

3. A plasma display device as set forth in claim 1, wherein a gap between row electrodes of said row electrode pair is at least 100 $\mu$m.

4. A plasma display device as set forth in claim 1, wherein a film thickness of said dielectric layer is at least 30 $\mu$m.

5. A plasma display device comprising a plasma display panel having a front substrate and a rear substrate, which are disposed so as to oppose each other with a discharge space there between, a plurality of row electrode pairs disposed on an inner surface of said front substrate and form display lines, a dielectric layer, which covers said row electrode pairs, a plurality of column electrodes disposed on an inner surface of said rear substrate and aligned so as to intersect said row electrode pairs to form discharge cells at respective intersection parts, a discharge gas in said discharge space, said discharge gas comprising a mixed noble gas having a xenon gas content of at least 10%, and an ultraviolet light emission layer disposed at a position between said front substrate and said rear substrate, to face the respective discharge cells, said ultraviolet light emission layer comprising an ultraviolet light emitting material having a phosphorescence characteristic of emitting ultraviolet rays upon being excited by ultraviolet rays emitted from said xenon gas as a result of discharge, general reset means, which causes a reset discharge for forming a wall charge inside all of said discharge cells, pixel data writing means, which causes a selective erasure discharge that selectively erases, in accordance with pixel data corresponding to an input video signal, said wall charge formed in said discharge cells, and emission sustaining means, which applies sustaining pulses, having a voltage value of at least 200 volts, to each row electrode of said pairs of row electrodes to cause only the discharge cells, in which said wall charge remains, to undergo repeated sustained discharge.

6. A plasma display device as set forth in claim 5, wherein the ultraviolet light emitting material contained in said ultraviolet light emission layer is a light emitting material with a persistence time of at least 0.1 msec.

7. A plasma display device as set forth in claim 5, wherein the ultraviolet light emitting material contained in said ultraviolet light emission layer is a light emitting material with a persistence time of at least 1 msec.

8. A plasma display device as set forth in claim 5, wherein said ultraviolet light emission layer contains a material having a work function of equal to or less than 4.5 eV.

9. A drive method for a plasma display comprising a front substrate and a rear substrate, which are disposed so as to oppose each other with a discharge space there between, a plurality of row electrode pairs disposed on an inner surface of said front substrate and form display lines, a dielectric layer, which covers said row electrode pairs, a plurality of column electrodes disposed on an inner surface of said rear substrate and aligned so as to intersect said row electrode pairs to form discharge cells at respective intersection parts, a discharge gas in said discharge space, said discharge gas comprising a mixed noble gas having a xenon gas content of at least 10%, and an ultraviolet light emission layer disposed at a position between said front substrate and said rear substrate, to face the respective discharge cells, said ultraviolet light emission layer comprising an ultraviolet light emitting material having a phosphorescence characteristic of emitting ultraviolet rays upon being excited by ultraviolet rays emitted from said xenon gas as a result of discharge, said plasma display panel drive method comprising executing a general resetting step only in a first sub-field of N sub-fields into which a display period of one field is divided and subjecting all of said discharge cells to reset discharge to form a wall charge in each of said discharge cells, wherein each of said N sub-fields comprises a pixel data writing step in which said discharge cells are selectively subject to erasure discharge by which the wall charge existing in said discharge cells is eliminated, and an emission sustaining step in which a sustaining pulse with a voltage value of at least 200V is applied to each of said discharge cells so that only those discharge cells in which said wall charge remains will undergo discharge emission for a number of times corresponding to a weight of the corresponding sub-field, and wherein said erasure discharge occurs only in said pixel data writing step in one of the sub-fields among said N sub-fields so as to perform said discharge emission continuously in said emission sustaining step in each of the n (n=0 to N) sub-fields that follow successively from the first sub-field.

10. A plasma display panel drive method as set forth in claim 9, wherein the ultraviolet light emitting material contained in said ultraviolet light emission layer is a light emitting material with a persistence time of at least 0.1 msec.

11. A plasma display panel drive method as set forth in claim 9, wherein the ultraviolet light emitting material contained in said ultraviolet light emission layer is a light emitting material with a persistence time of at least 1 msec.

12. A plasma display panel drive method as set forth in claim 9, wherein said ultraviolet light emission layer contains a material having a work function of equal to or less than 4.5 eV.

* * * * *